US007441723B2

(12) United States Patent
Chen

(10) Patent No.: US 7,441,723 B2
(45) Date of Patent: Oct. 28, 2008

(54) ROLLING AND FEEDING STRUCTURE OF A FABRIC ROLLING MACHINE

(75) Inventor: Shih-Chi Chen, Taipei Hsien (TW)

(73) Assignee: Pai Lung Machinery Mill Co., Ltd., Jui-Fang Town, Taipei Hsien (TW)

( * ) Notice: Subject to any disclaimer, the term of this patent is extended or adjusted under 35 U.S.C. 154(b) by 368 days.

(21) Appl. No.: 11/267,272

(22) Filed: Nov. 7, 2005

(65) Prior Publication Data

US 2007/0102558 A1 May 10, 2007

(51) Int. Cl.
*B65H 18/16* (2006.01)

(52) U.S. Cl. ..... 242/541; 242/598.2; 242/526; 242/533.2; 242/534

(58) Field of Classification Search ..... 242/526, 242/533, 534, 534.2, 541, 533.2, 598.2
See application file for complete search history.

(56) References Cited

U.S. PATENT DOCUMENTS 1,353,634 A * 9/1920 Crandell ..... 242/524
1,635,024 A * 7/1927 Baker ..... 139/308
3,851,832 A * 12/1974 Krueckels et al. ..... 242/541.6
5,184,787 A * 2/1993 Holzinger et al. ..... 242/352.2
5,317,885 A * 6/1994 Vignoni ..... 66/151
5,560,566 A * 10/1996 Bagnato ..... 242/541.1

FOREIGN PATENT DOCUMENTS

TW 542267 7/2003
TW M266302 U 6/2005

* cited by examiner

*Primary Examiner*—Peter M. Cuomo
*Assistant Examiner*—Stefan Kruer
(74) *Attorney, Agent, or Firm*—Muncy, Geissler, Olds, & Lowe PLLC

(57) ABSTRACT

A rolling and feeding structure of a fabric rolling machine comprises a frame disposed on the fabric rolling machine, a transmission axle rotatably coupled to a sidewall of the frame, two lumps, two stoppers corresponding to the lumps and each having an end pivotally coupled to the frame, a displacement gap defined between the stopper and the lump for installing a rolling rod and enabling a displacement of the rolling rod from the starting point of the transmission axle in the displacement gap, two limit members for forming a fixing relation with the stoppers and including a first position of the displacement gap and having a fixing relation with the stopper, and a second position with an open angle formed between the limit member and the lump for releasing the fixing relation. The foregoing measure improves the fabric rolling quantity and features an easy operation for feeding the fabric.

14 Claims, 6 Drawing Sheets

ROLLING AND FEEDING STRUCTURE OF A FABRIC ROLLING MACHINE

FIELD OF THE INVENTION

The present invention relates to a rolling and feeding structure of a fabric rolling machine, and more particularly to a rolling and feeding structure of a fabric rolling machine that form an open angle between a stopper and a lump.

BACKGROUND OF THE INVENTION

A conventional rolling and feeding structure of a fabric rolling machine was disclosed in R.O.C. Patent No. M266302 entitled "Fabric collecting roll bracket assembly". Such patent discloses a traditional fabric rolling machine comprising two adjacent guide rolls disposed on a corresponding lateral machine box, at least one spread rod (or related spread device) disposed at a lateral side of the guide roll, an aslant guide track disposed between two guide rolls at the top of the internal side of the lateral machine box, and the two guide tracks include a guide groove for containing a rolling rod, and a secondary machine box extended transversally on the same side of a lateral side at the top of the two lateral machine boxes, and two guide rods disposed between the two secondary machine boxes and rotating in opposite directions for receiving the cloth delivered from a circular knitting machine, roll pressing and being delivered to the spread rod or related spread device, so that the cloth is spread and pulled externally towards both lateral sides of the cloth, and then guided and driven by the guide roll to roll the cloth onto the periphery of the rolling rod. The rolling rod can be shifted upward along the guide groove as the thickness of the cloth rolled on the periphery increases. After the rolling rod completes rolling the cloth, an operator has to cut the cloth and immediately pack the cloth roll (which is a rolling rod wound with cloth) to prevent the cloth from being loosened gradually from the periphery of the rolling rod. Therefore, the cloth is generally cut and the cloth roll is packed immediately after the rolling operation is completed, and the rolling rod is taken out from the guide groove to facilitate shipping the cloth to the warehouse or transporting the cloth. However, the weight of the cloth roll is approximately 35 to 45 Kg (depending on the width and thickness of the cloth). It is not easy for an operator to lift the cloth roll for the cutting and packaging operations. In general, one side of the cloth roll is lifted first and then another side is lifted after the operation is completed. Such arrangement not only wastes time and efforts, but also has no control on the quality of the packaging.

R.O.C. Patent No. M266302 discloses a fabric collecting roll bracket assembly comprising a guide track and a lateral guide frame, wherein the guide track includes a long bar body with a U-shape cross section disposed in the middle of the guide track, and the lateral guide frame is a bar having an L-shape cross section and connected to an end section with an angle, so that a lateral side of the lateral guide frame is connected to the bottom of the groove of the guide track, and a bottom surface is received by a hollow section on a lateral side of the guide track. A plurality of insert holes is disposed at the bottom surface for receiving an insert pin separately to define a stopping position for different positions, so that the guide track is fixed at the middle section of an internal side of the lateral machine box of the fabric rolling machine for guiding the rolling rod upward. After the cloth is rolled, the rolling rod can be moved transversally and across the bottom surface of the lateral guide frame, and then stopped by the insert pin, so that the rolling rod is placed at a position temporarily to facilitate carrying out the operations of cutting and packaging the cloth. Such patent provides convenient operations, effectively saves power, and enhances efficiency.

R.O.C. Patent Publication No. 542267, entitled "Improved structure of a cloth cutting machine" also discloses a rolling and feeding structure that comprises a spread rod, a receiving rod, and an unfolding rod disposed adjacent to a cloth rolling unit, and the spread rod of the cloth rolling unit is extended downward to connect to a horizontal axle of the unfolding rod and the receiving rod. Therefore, the cloth is pulled and delivered in a short distance, and the cloth rolled on the cloth rolling unit will not have uneven surface tension on the cloth due to the pulling and delivery of the cloth for several times. A control rod installed on a displacing structure provides the switch of the movements and facilitates users to take out, remove, or control the cloth to roll up and down to contact with the receiving rod, so as to prevent the cloth from being over-rolled which may affect the quality of the cloth.

SUMMARY OF THE INVENTION

The primary objective of the present invention is to overcome the foregoing shortcomings and avoid the existing deficiencies by providing a rolling and feeding structure to greatly increase the cloth rolling quantity of the fabric rolling machine.

To achieve the foregoing objective, a rolling and feeding structure of the present invention comprises a frame disposed on the fabric rolling machine, a transmission axle pivotally coupled to a sidewall of the frame, two lumps, and two stoppers corresponding to the lump and having an end pivotally coupled to a sidewall of the frame, and a displacement gap is defined between the stopper and the lump for installing a rolling rod driven by the transmission axle and producing a displacement from the starting point of the transmission axle in the displacement gap for the rolling rod, and the two limit members form a fixing relation with the stopper and have a first position of the displacement gap to form a fixing relation with the stopper, and a second position with an open angle disposed between the limit member and the lump for releasing the fixing relation. The open angle facilitates the cloth feeding movement of the rolling rod wound with the cloth. It no longer needs to lift up the whole rolling rod, and thus greatly enhancing the operating efficiency and the performance of rolling cloth.

DETAILED DESCRIPTION OF THE PREFERRED EMBODIMENTS

Figure 1:
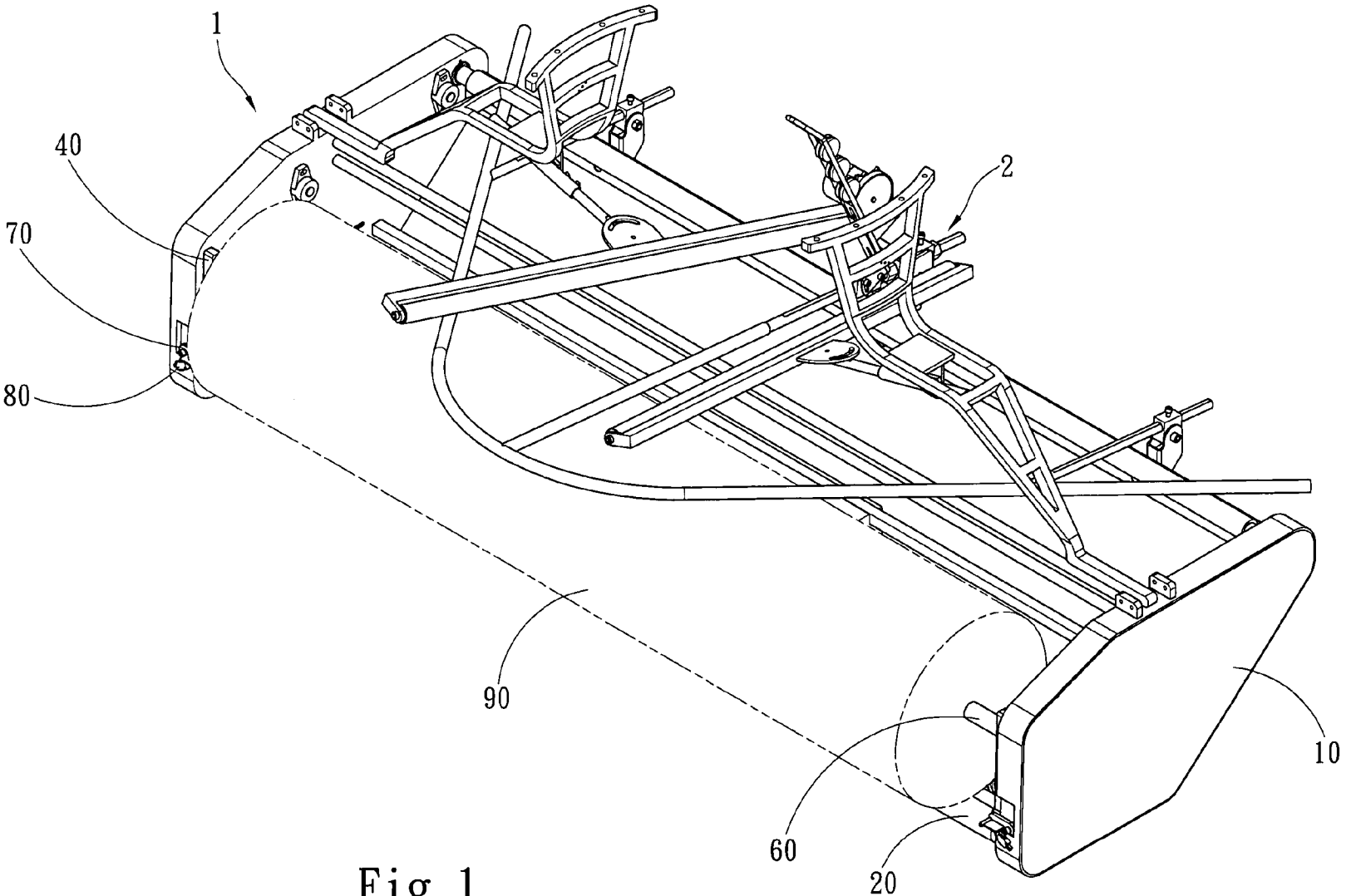
FIG. 1 is a perspective view of the invention.

The present invention will now be described in more detail hereinafter with reference to the accompanying drawings that show various embodiments of the invention.

Referring to FIGS. 1 and 2A to 2C for the perspective view and enlarged views of part of the present invention, a rolling and feeding structure of a fabric rolling machine is used in a fabric rolling machine 1, and this preferred embodiment uses a cloth cutting type fabric rolling machine for example. Compared with the traditional fabric rolling machine, the fabric rolling machine 1 of the present invention further comprises a cutting device 2 for cutting the cloth, so that the fabric rolling machine 1 has better functions and is more convenient. The rolling and feeding structure of a fabric rolling machine of the invention comprises a frame 10 disposed on the fabric rolling machine 1, a transmission axle 20 pivotally coupled to a sidewall of the frame 10, two lumps 30 corresponding and being fixed to the sidewall of the frame 10, two stoppers 40 corresponding to the lumps 30 and having an end pivotally coupled to the sidewall of the frame by a pivotal axle. The frame 10 includes a sensor 80 corresponding to the stopper 40, and the sensor 80 is electrically connected to a switch circuit of the fabric rolling machine 1. The stopper 40 and the lump 30 are installed parallel to each other, and a displacement gap 50 is defined between the stopper 40 and the lump 30. The displacement gap 50 includes a rolling rod 60 driven by the transmission axle 20 for producing a displacement of the rolling rod 60 from the starting point of the transmission axle 20 in the displacement gap 50. Two limit members 70 pivotally coupled onto the frame 10 to form a fixing relation with the stopper 40, and the limit member 70 forms a first position and a second position of a force applying section 71 for applying a force for a rotation. The stopper 40 includes a fixing section 41 corresponding to the limit member 70 and forming the fixing relation, and the limit member 70 has a first position of the displacement gap 50 for forming a fixing relation with the stopper 40 and a second position with an open angle formed between the limit member 70 and the lump 30 for releasing the fixing relation. The sensor 80 forms a fixing relation with the stopper 40 when the stopper 40 is at the first position.

Figure 2A:
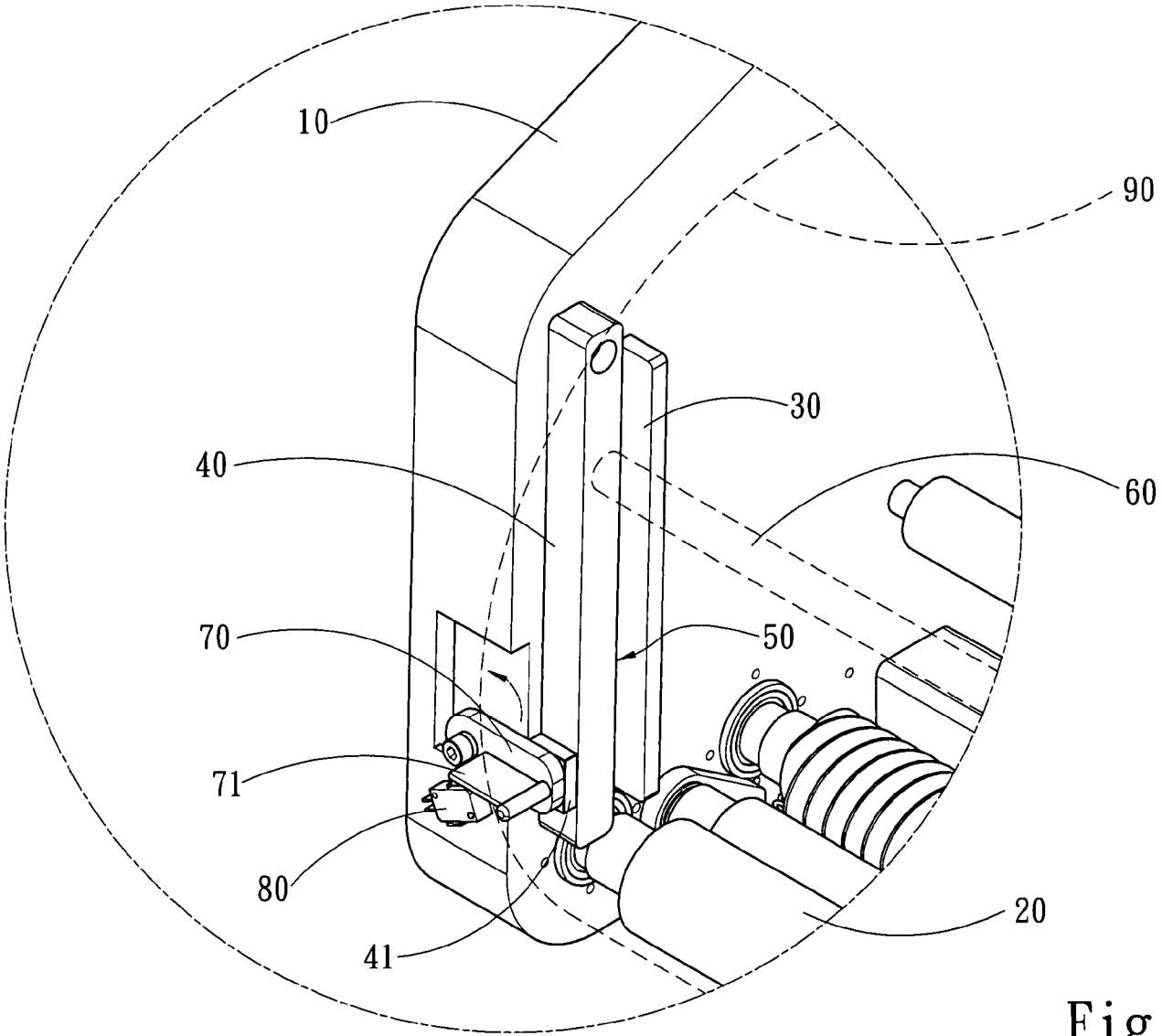
FIGS. 2A to 2C are schematic enlarged views of a section of the present invention.
Figure 2B:
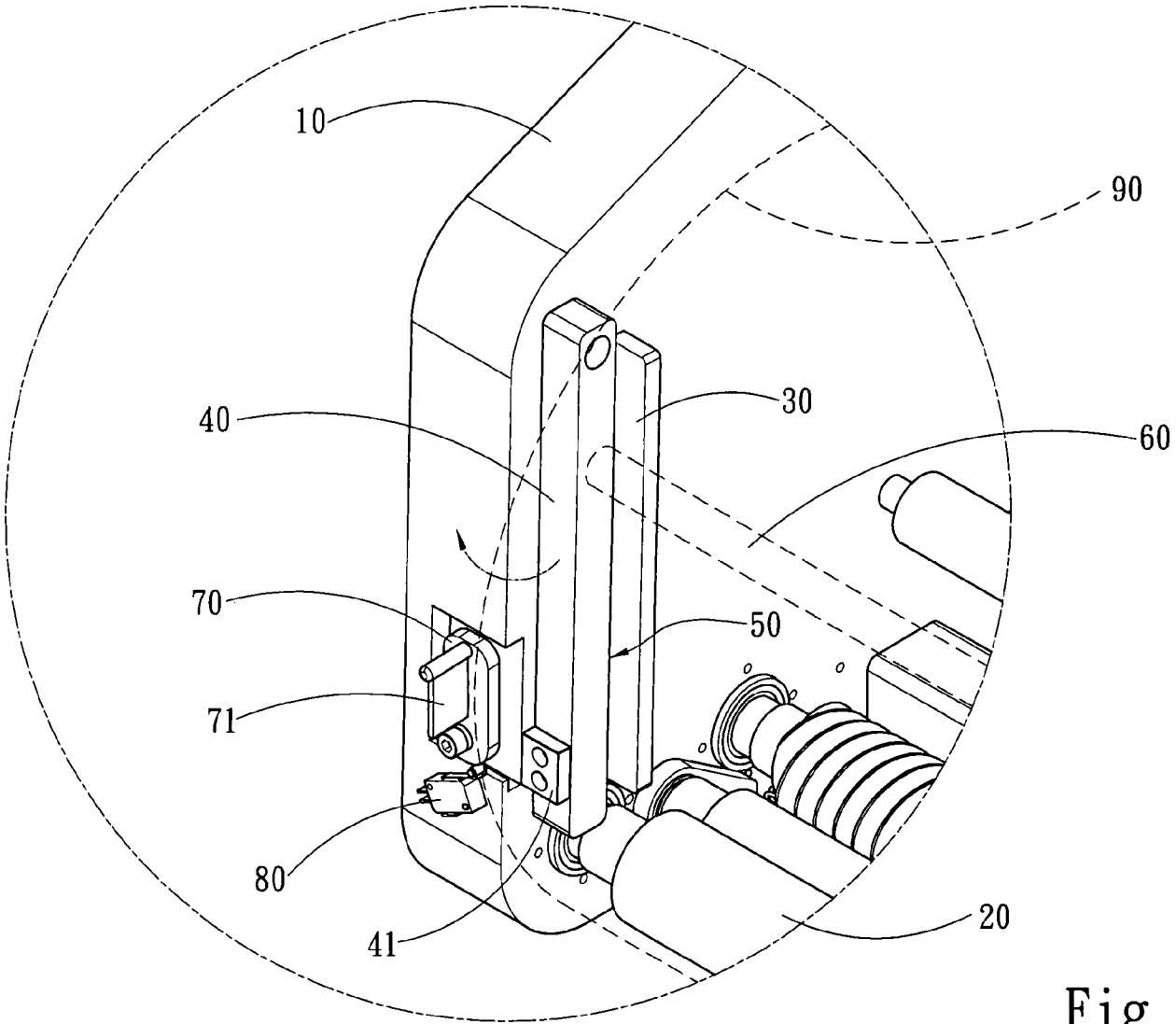
Figure 2C:
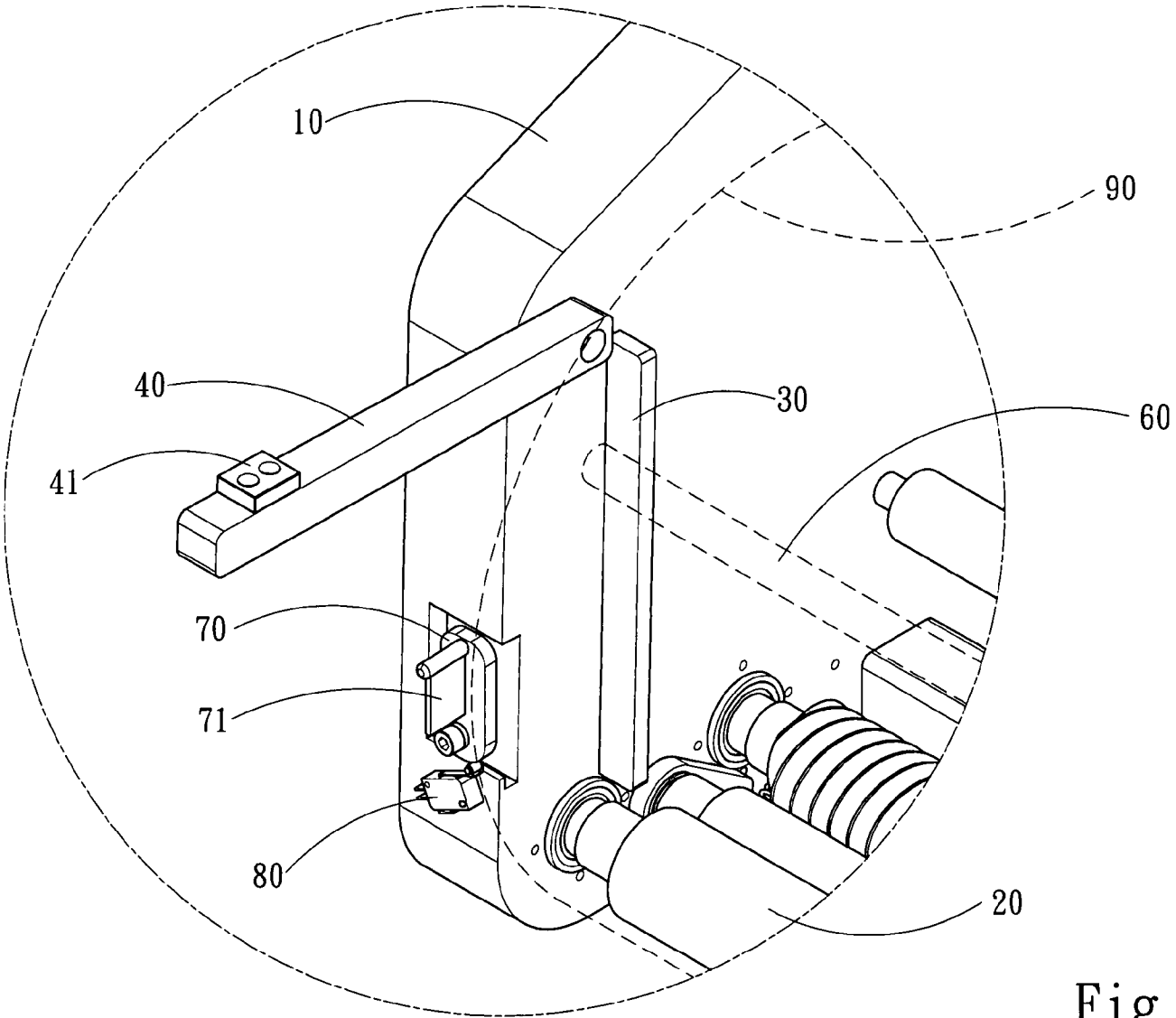
Figure 3A:
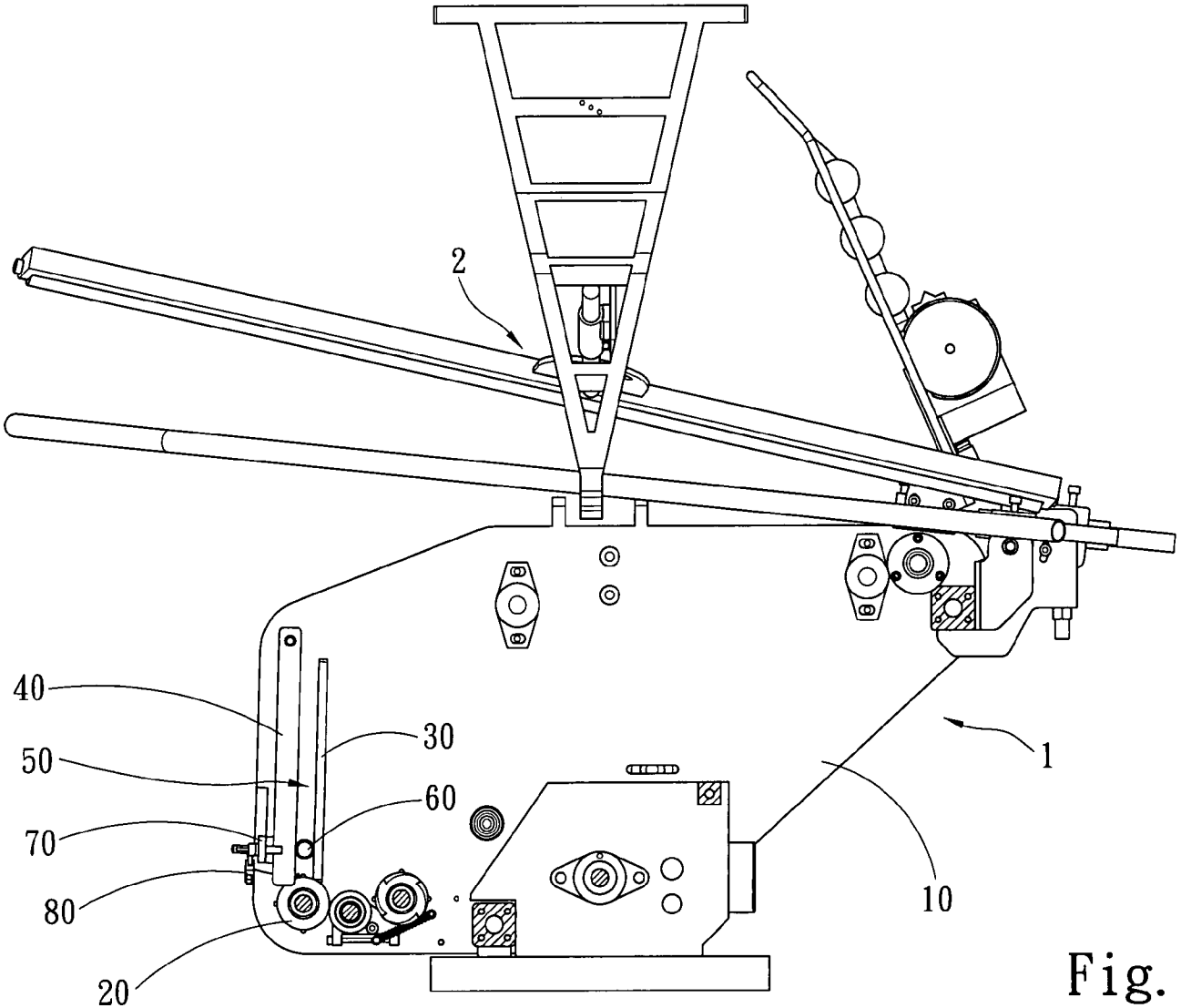
FIGS. 3A to 3B are cross-sectional views of movements of the present invention.
Figure 3B:
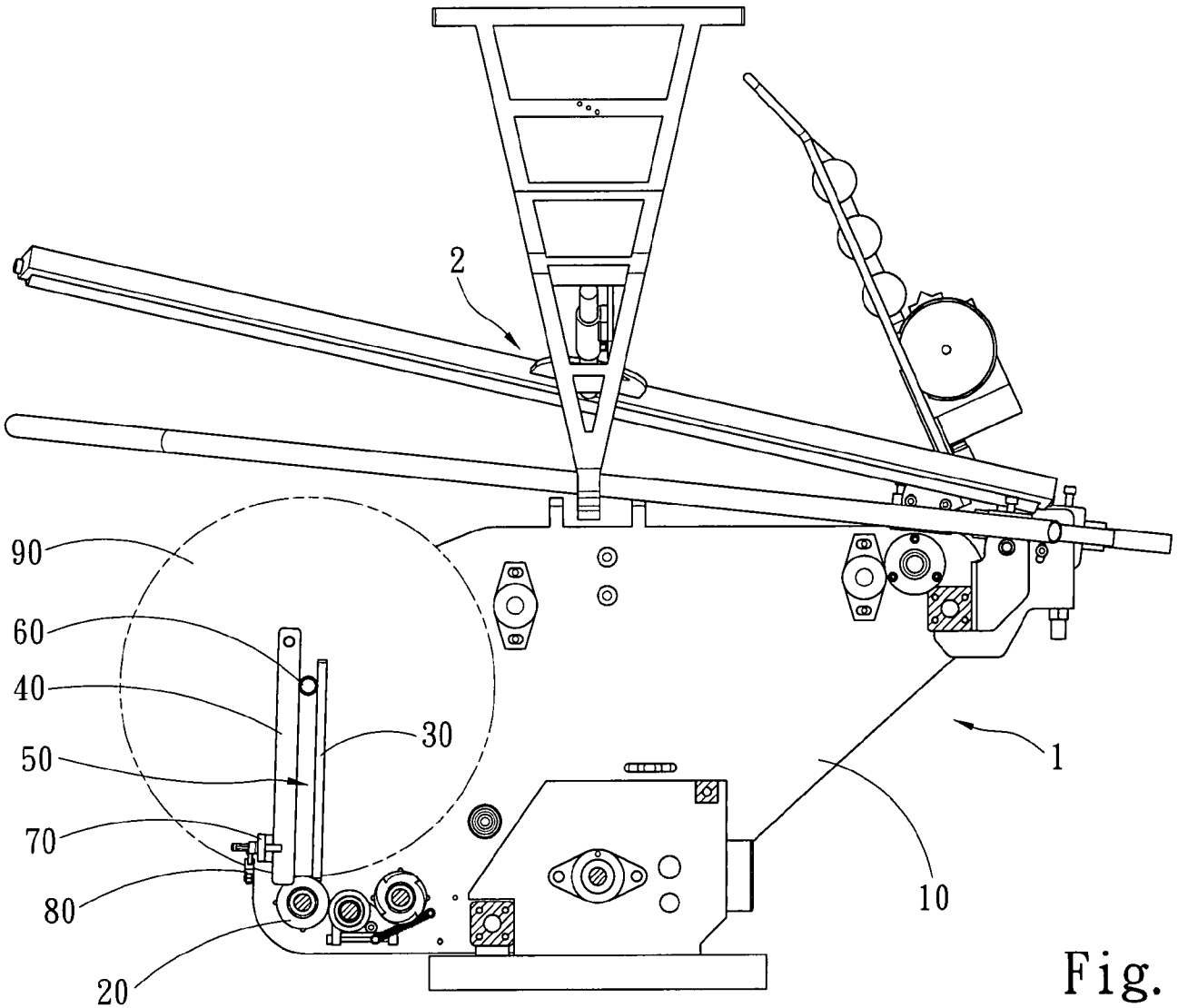

In other words, the limit member 70 forms a fixing relation with the stopper 40, when the limit member 70 is situated at the first position, so that a displacement gap 50 is defined between the stopper 40 and the lump 30, and the limit member 70 and the sensor 80 form a connecting status, and thus driving the fabric rolling machine 1 to move as shown in FIG. 2A. When the fabric rolling machine 1 is operated, the rolling rod 60 is driven by the transmission axle 20 for carrying out the cloth rolling, and the rolling rod 60 is connected by the cloth 90 and the transmission axle 20, and the thickness of the cloth 90 increases as the rolling continues and thus pressing on the transmission axle 20 and producing a displacement in the displacement gap 50 by using the transmission axle 20 as the starting point (as shown in FIGS. 3A and 3B). When a sufficient quantity of the cloth 90 on the rolling rod 60 is reached, the cloth is unloaded. A user applies a force to the force applying section 71 of the limit member 70, so that the limit member 70 enters into the second position to release the fixing condition between the limit member 70 and the stopper 40. Now, the sensor 80 prevents the rolling rod 60 of the fabric rolling machine 1 from being started when the rolling rod 60 is not fixed into a position, and thus the invention is very safe (as shown in FIG. 2B). The released stopper 40 is spread open and the lump 30 forms an open angle, so that the rolling rod 60 together with the cloth 90 can be unloaded successfully (as shown in FIG, 2C). In the figure, it is not necessary to lift the rolling rod 60 together with the cloth 90 for unloading the cloth, and thus the present invention can save manpower and improve the operating efficiency. The present invention also can prevent the rolling rod 60 from touching other devices such as a cutting device 2 at the top of the cloth 90 when the rolling rod 60 is lifted to unload the cloth 90 as shown in FIG. 3B, and thus can greatly improve the cloth rolling quantity of the fabric rolling machine 1.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A rolling and feeding structure of a fabric rolling machine, comprising:

a frame disposed on said fabric rolling machine and having a transmission axle rotatably coupled to said frame and two corresponding lumps fixed on a sidewall of said frame;

a stopper corresponding to each of said lumps and having an end pivotally coupled to a sidewall of said frame, and defining a displacement gap disposed between said stoppers and said lumps, and a rolling rod being disposed in said displacement gap and driven by said transmission axle, said rolling rod moves vertically from a starting point of said transmission axle in said displacement gap as fabric is wound thereon; and two limit members pivotally coupled on said frame and forming a relation of fixing said stopper, and said limit member having a first position of said displacement gap for producing a fixing relation with said stopper, and a second position with an open angle disposed between said limit member and said lumps for releasing said fixing relation.

2. The rolling and feeding structure of a fabric rolling machine of claim 1, wherein said frame includes a sensor corresponding to said stopper.

3. The rolling and feeding structure of a fabric rolling machine of claim 1, wherein said stoppers are installed parallel to said lumps.

4. The rolling and feeding structures of a fabric rolling machine of claim 1, wherein said stopper includes a fixing section corresponding to said limit member for forming a fixing relation.

5. The rolling and feeding structure of a fabric rolling machine of claim 1, wherein said stopper has an end pivotally coupled with said frame by a pivotal axle.

6. The rolling and feeding structure of a fabric rolling machine of claim 1, wherein said limit member includes a force applying section of said first and second positions for applying a force for a rotation.

7. The rolling and feeding structure of a fabric rolling machine of claim 1, wherein the displacement gap is between the lumps and the stoppers, the displacement gap having a uniform width when the limit members are in the first position and having a varying width when the limit members are in the second position and the stoppers are pivoted away from the lumps.

8. The rolling and feeding structure of a fabric rolling machine of claim 1, wherein the stoppers are pivotable toward and away from the lumps, the stoppers being held in a fixed position when the limit members are in the first position, the stoppers each being pivotable about a first axis and the limit members being pivotable about axes which are non-parallel to the first axis.

9. The rolling and feeding structure of a fabric rolling machine of claim 1, wherein the stoppers are each pivotable about first axes and wherein the limit members are each pivotable about second axes, the first axes being perpendicular to the second axes.

10. The rolling and feeding structure of a fabric rolling machine of claim 1, wherein the lumps have a side which is parallel to the corresponding stopper when the limit members are in the first position and the lumps and stoppers are closed, the rolling rod being held between the stoppers and lumps when the lumps and stoppers are closed, the stoppers being pivotable away from the lumps when the limit members are moved to the second position whereby the rolling rod is removable from between the stoppers and lumps.

11. The rolling and feeding structure of a fabric rolling machine of claim 1, wherein at least one of the limit members engages a sensor when in the first position and is movable out of engagement with the sensor when in the second position, the sensor controlling operation of the transmission axle.

12. The rolling and feeding structure of a fabric rolling machine of claim 2, wherein said sensor forms a connecting relation when said stopper is situated at said first position.

13. The rolling and feeding structure of a fabric rolling machine of claim 2, wherein said sensor is electrically connected to a switch circuit of said fabric rolling machine.

14. The rolling and feeding structure of a fabric rolling machine of claim 10, wherein the stoppers are each pivotable about first axes and wherein the limit members are each pivotable about second axes, the first axes being perpendicular to the second axes.

* * * * *